United States Patent [19]

Imamura et al.

[11] Patent Number: 4,924,143

[45] Date of Patent: May 8, 1990

[54] COLORED FLUOROESCENT DISPLAY LAMP ASSEMBLY

[75] Inventors: Hiroshi Imamura; Makoto Toho; Eiji Shiohama; Shoiti Morii; Koji Hiramatsu, all of Kadoma, Japan

[73] Assignee: Matsushita Electric Works, Ltd., Osaka, Japan

[21] Appl. No.: 210,809

[22] Filed: Jun. 24, 1988

[30] Foreign Application Priority Data

Jul. 9, 1987 [JP] Japan ..... 62-171642
Jul. 9, 1987 [JP] Japan ..... 62-171643

[51] Int. Cl.[5] ..... H01J 61/33; H01J 61/48

[52] U.S. Cl. ..... 313/493; 313/610; 313/634; 313/318

[58] Field of Search ..... 313/493, 610, 634, 318; 340/772

[56] References Cited

U.S. PATENT DOCUMENTS 2,265,323 12/1941 Spanner .
4,199,708 4/1980 Lauwerijssen et al. ..... 313/493
4,665,341 5/1987 Imamura et al. ..... 313/493
4,727,284 2/1988 Ohkoshi et al. ..... 313/493 X

FOREIGN PATENT DOCUMENTS 62-188159 8/1987 Japan .

*Primary Examiner*—Palmer C. DeMeo
*Attorney, Agent, or Firm*—Burns, Doane, Swecker & Mathis

[57] ABSTRACT

A colored fluorescent display lamp assembly has a lamp housing in which a plurality of discharge chambers are defined. Discharge holes of the respective discharge chambers are disposed in a central area of a bottom wall of the housing. A lamp base, formed by a relatively thin lightweight material, carries therein an electrode common to all of the discharge chambers. The base has an open end sealed to the central area of the lamp housing bottom wall to enclose the discharge holes. The lamp assembly can be thereby minimized in weight and size.

12 Claims, 11 Drawing Sheets

COLORED FLUOROESCENT DISPLAY LAMP ASSEMBLY

TECHNICAL BACKGROUND OF THE INVENTION

This invention relates to colored fluorescent display lamp assemblies and, more particularly, to a fluorescent lamp assembly having a plurality of differently colored fluorescent luminouse parts arranged for selective lighting on and off to achieve image display with variably colored light.

The colored fluorescent display lamp assemblies of the kind referred to may be effectively applied, for example, to an image display device, fluorescent variable-color lamp device and the like for realizing fully variably colored display, illumination and the like.

DISCLOSURE OF PRIOR ART

A colored fluorescent lamp assembly of the kind referred to has been disclosed n U.S. Pat. No. 4,199,708 to Petrus C. Lauwerijssen et al, as including a base plate positioned on a lamp base and provided with a pair of negative and positive electrodes, and a U-shaped lamp tube having longer and shorter leg portions. The tube is supported at the longer leg portion on the base plate in cantilever form to enclose therein the positive electrode. A dome-shaped outer envelope is fixed to the base plate to limit a gas-tight space around the lamp tube and the negative electrode. In this arrangement, the shorter leg portion of the lamp tube is opened and separated from the base plate and the entire lamp tube is enclosed in the envelope. Thus, with the interior of the lamp tube as well as the envelope filled with a discharge gas, the interior of the envelope can be also made utilizable as a part of a discharge space in addition to that of the lamp tube as made to communicate therewith through open end of the short leg portion, and a proper discharge lighting can be performed between the positive electrode in the lamp tube and the negative electrode in the envelope. Further, this fluorescent lamp may be modified in view of another U.S. Pat. No. 2,265,323 to H. J. Spanner showing a discharge tube having at its one end a single negative electrode and at the other branched ends a plurality of positive electrodes so that the single negative electrode can be used in common with the positive electrodes respectively enclosed in one end of each of a plurality of the lamp tubes within the gas-tight space of the envelope. This provides for a controllable lighting with a single control means of a proper discharge between the common negative electrode and the plurality of positive electrodes.

In the case of the arrangement based on these U.S. Patents, it is an advantage that only a single light control means is needed, but it is considered that various problems arise in realizing this arrangement. More particularly, in the foregoing U.S. Pat. No. 4,199,708, the utilization of the whole interior of the envelope as the discharge space has made it possible to render the negative electrode to be single, but a disadvantage exists practically in that the discharge space is unnecessarily increased in size, because it is required for the colored lighting to render only the lamp tube interior coated with a coloring fluorescent substance to be contributive to the lighting. While it is generally required, further, to effectively prevent any foreign matter from being admitted into the discharge space to avoid its adverse affect on the discharging operation, the structure based on the foregoing U.S. Patents involves an apparent problem that, as compared with the case where the admission preventive measure is called for only with respect to the lamp tube interior, the preventive measure is necessitated also for the considerably larger space in the envelope, and the manufacture must be performed with more precision. Further, such double structure as in the U.S. Pat. No. 4,199,708 of the inner lamp tube and outer envelope causes another problem to arise in raising the temperature within the lamp tubes to a level beyond a desired limit temperature, due to a heat insulation of the outer envelope, whereby normally caused deterioration of the fluorescent substance on the inner surface of the lamp tubes is accelerated to quickly lower the chroma of the emitted colored light. In this U.S. patent, further, the cantilevered support at the longer leg portions of the lamp tubes with respect to the base plate within the gas-tight envelope makes it difficult to achieve a sufficiently high holding strength for the lamp tubes, so that there arises a risk that any vibratory motion given to the fluorescent lamp assembly during its transportation or the like may result in an easy disconnection of the tubes from the base plate for disabling the assembly.

There has been suggested by Hiroshi Imamura et al, as disclosed in U.S. Pat. No. 4,665,341, a colored fluorescent lamp assembly for eliminating the respective problems in the foregoing. According to Imamura et al, a gas-tight space through which a plurality of colored fluorescent lamp tubes communicate with each other at their one open end is secured to such open ends of the lamp tubes in the form of a cell of a dimension smaller in a direction parallel to longitudinal axes of the lamp tubes than that of the tubes and accommodating therein a common electrode. With this lamp assembly, the outer dimensions can be minimized, the required measures for preventing the foreign matter admission into the discharge space can be minimized, and the lamp tubes can be prevented from causing their heat to excessively rise, whereby the colored fluorescent lamps improved in such various respects as in the above can be sufficiently utilized in practice. On the other hand, there still remains a problem that the erected provision of the lamp tubes in their longitudinal direction does not allow a sufficiently high mechanical strength to be provided to the assembly so that the manufacture of the assemblies or their assembling work into a large size display device has to be carried out with an attention paid to this respect, and the workability is left not to be improved.

In order to eliminate the problem left in the colored fluorescent lamp assembly of the U.S. Pat. No. 4,665,341, Hiroshi Imamura et al have further suggested such a fluorescent lamp as disclosed in Japanese Patent Application Laid-Open Publication No. 62-188159, in which the fluorescent lamp comprises a ceramic lamp housing opened on one side and defining therein by partitions a plurality of discharge paths. Side and bottom walls of the respective paths are coated with fluorescent substances capable of emitting differently colored lights, and the respective paths having electrodes and discharge holes made in the bottom walls. A ceramic base has in the interior thereof a common electrode and is secured at an open end gas-tightly to a bottom face of the lamp housing so that the interior will communicate through the discharge holes with the interior of the respective discharge paths. Open sides of the paths are gas-tightly sealed by a transparent glass plate after filling the interior of the lamp housing and base with a discharge gas of mercury vapor and an inactive gas. With this arrangement, the lamp tubes have been replaced by the discharge paths defined in the ceramic lamp housing, and a satisfactory mechanical strength can be provided. This lamp is formed, however, by a ceramic material except for the glass plate secured to the open side of the lamp housing, and any mold-formed ceramic member is required to be made relatively thick from the viewpoint of practically utilizable strength and thus is heavy. If a large size display device is to be prepared with a large number of such fluorescent lamps, therefore, it becomes necessary to largely increase the mechanical strength of support means for the entire display device or of holding means for lamp casings or the like in which the respective fluorescent lamps are housed, so that there arises a problem that the gross weight of the device will be large and assembling works will be also made complicated. In gas-tightly bonding ceramic members to each other, further, it is generally necessary to make the sealing area large, but there still remains a risk that sealing is not sufficiently good because ceramic members are poor in surface flatness.

TECHNICAL FIELD OF THE INVENTION

A primary object of the present invention is, therefore, to provide a colored fluorescent display lamp assembly which has eliminated the foregoing problems by a structure in which one of the discharge electrodes is made common for a plurality of discharge paths having respectively the other electrode for a fully variably colored display, the assembly being light in weight and minimized in size so that required supporting or holding means for assembling a larger number of the lamp assemblies can be made light and simple.

According to the present invention, the above object can be realized by means of a colored fluorescent display lamp assembly comprising a lamp housing opened on one side and having therein a plurality of discharge chambers defined by a separator and provided respectively with main electrodes projected into each chamber and with discharging holes made in the bottom wall. An inner wall face of the respective chambers is coated with differently coloring fluorescent substances, and a lamp base is secured to the bottom wall face of the lamp housing to communicate the interior with the discharge chambers in the housing through the discharging holes. The base has therein a common electrode, and the open side of the lamp housing is gas-tightly sealed by a glass plate with a discharge gas sealed inside the lamp housing and lamp base. The discharging holes are collectively disposed in the center area of the lamp housing, and the lamp base is formed by a relatively thin and light-weight member of smaller cross-section thickness than the lamp housing and is gas-tightly bonded at one open end to the bottom wall face of the housing so as to enclose the discharging holes in the central area.

Other objects and advantages of the present invention shall be made clear in following description of the invention detailed with reference to preferred embodiments shown in accompanying drawings.

While the present invention shall now be explained with reference to the respective embodiments shown in the accompanying drawings, it should be appreciated that the intention is not to limit the invention only to such embodiments shown but to rather include all alterations, modifications and equivalent arrangements possible within the scope of appended claims.

DISCLOSURE OF PREFERRED EMBODIMENT

Figure 1:
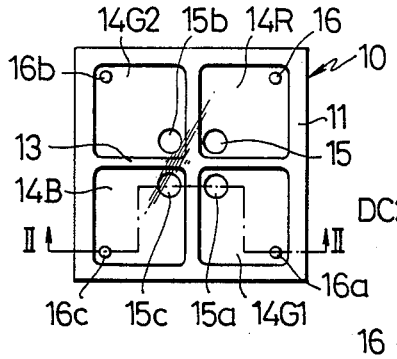
FIG. 1 shows in a plan view an embodiment of the colored fluorescent display lamp assembly according to the present invention.
Figure 2:
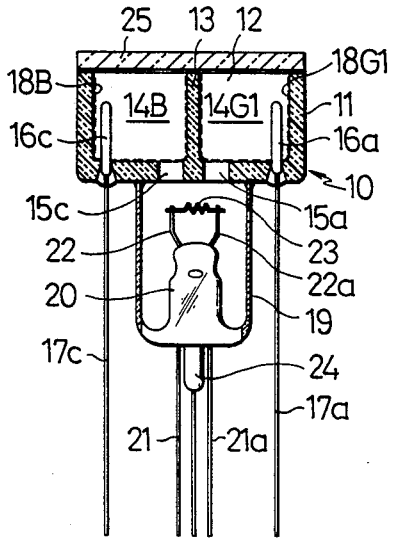
FIG. 2 is a sectioned view of the lamp assembly taken along line II—II in FIG. 1.

Referring to FIGS. 1 and 2, a colored fluorescent display lamp assembly 10 of the present invention generally comprises a lamp housing 11 of a box shape opened on one side which is a top side face in the positional relationship of the drawings. This lamp housing 11 is formed by a material non-permeable to light and high in reflectance with respect to visible light such as a ceramic, metal or the like, to have a luminous part 12 in which a separator 13 of a cruciform as seen from the top open side, that is, in the plan view of FIG. 1 is provided to define therein four discharge chambers 14R, 14G1, 14G2 and 14B inside and continuous to the open side of the housing. In a wall opposite to the open top side face, that is, in bottom wall of the lamp housing 11, there are provided discharge holes 15, **15*a*, 15*b* and 15*c* respectively in each of the discharge chambers 14R–14B at a position adjacent the central intersection of the cruciform separator 13 or, in other words, concentratively in a central zone in the closed bottom wall of the lamp housing 11. Main electrodes 16, 16*a*, 16*b* and 16*c* are projected through the bottom wall respectively into each of the discharge chambers 14R–14B at a position substantially furthest in each chamber from the intersection of the cruciform separator 13, that is at a position adjacent each corner diagonally opposite to the discharge holes 15–15*c*. In the present instance, the main electrodes 16–16*c* are passed through the closed bottom wall of the lamp housing to project into the discharge chambers 14R–14B substantially the entire body of the electrode, and are respectively secured at the base part to the bottom wall of the housing while external lead wires 17, 17*a*, 17*b* and 17*c* are connected to the base part of the electrodes (while only two of which lead wires are shown in the drawing). Onto the inner wall surface of the respective discharge chambers 14R, 14G1, 14G2 and 14B are applied, fluorescent substances 18R, 18G1, 18G2 and 18B which provide different colors upon light emission, such that the fluorescent substance 18R is a red fluorescent substance (in particular, YOX, chemical formula $Y_2O_3$:Eu), the substances 18G1 and 18G2 are of a green fluorescent substance (in particular, CAT, chemical formula $CeMgA1_{11}O_{19}$:Tb), and the substance 18B is of a blue fluorescent substance (in particular, BAM, chemical formula $BaMg_2A1_{16}O_{29}$:Eu), and it is preferable that the green fluorescent substance is applied to two diagonally opposing chambers 14G1 and 14G2**.

On the outer side of the bottom wall of the lamp housing 11, is mounted a lamp base 19 formed by a relatively light weight material such as a glass. The base 19 is configured substantially into a cylindrical shape opened at one axial end and closed at the other end while made thin in peripheral body thickness. The base 19 is sealingly secured at the open end through a glass frit or the like sealing means. This lamp base 19 is of such size that the open axial end can fully enclose the discharge holes **15–15*c* of the housing 11 while the closed end is projected inward to form a stem 20 carrying external lead wires 21 and 21*a* joined at their inner ends with lead-in wires 22 and 22*a* which are holding between them a filament type common electrode 23. Projected out of the closed end is an exhaust tube 24** which is gas-tightly closed after exhausting interior air upon filling the interior with the discharge gas.

On the open side of the lamp housing 11, on the other hand, a light permeable plate 25 of a transparent glass or the like is sealingly secured through a glass frit or the like bonding means, whereby the discharge chambers 14R–14B functioning as the luminous part 12 define a gas-tightly sealed isolated space communicating through the discharge holes **15–15*c* only with the interior of the lamp base 19, and this isolated space including the chambers 14R–14B and the interior of the base 19** is filled with a discharge gas of a mixture gas of, for example, such inactive gas as argon and mercury vapor.

Figure 3:
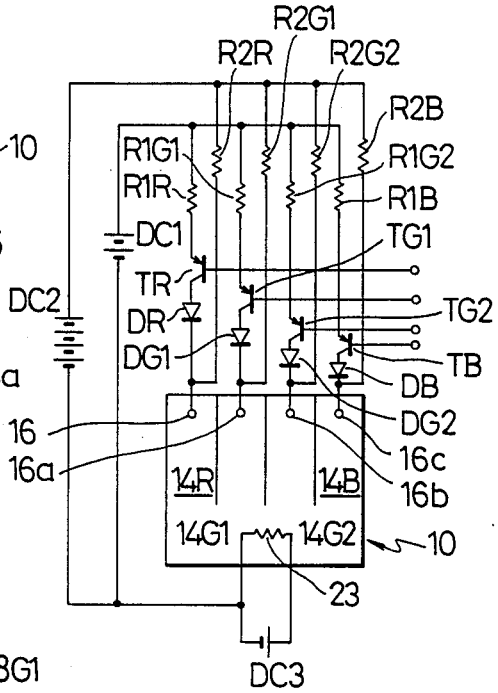
FIG. 3 is a diagram showing a lighting circuit for the lamp assembly of FIG. 1.

In lighting the lamp assembly 10 of FIGS. 1 and 2, such a lighting circuit as shown in FIG. 3 may be employed, which circuit comprises a first DC source DC1 applying a discharge voltage between the respective main electrodes **16–16*c* and the common electrode 23. A positive electrode of the source DC1 is connected to the main electrodes 16–16*c* respectively through a series circuit of a resistor R1R, R1G1, R1G2 or R1B as a current limiting element, a transistor TR, TG1, TG2 or TB, and a diode DR, DG1, DG2 or DB for preventing any reverse flow of the current, so that a selective conduction of the transistors TR-TB (details of which are omitted here since a driving arrangement disclosed in U.S. Pat. No. 4,665,341 to Imamura et al may be employed, if necessary) will allow the source DC1 voltage applied across one or ones of the main electrodes connected to the selectively conducted transistor or transistors and the common electrode 23 connected to a negative electrode of the source DC1. The lighting circuit further comprises a second DC source DC2, a positive electrode of which is connected through a high resistor R2R, R2G1, R2G2 or R2B to the respective main electrodes 16–16*c* while a negative electrode of which is connected to the negative electrode of the first source DC1. In the present instance, the second source DC2 voltage is made to be at a level capable of realizing a micro discharging which is insufficient for causing the luminescence to take place in any of the discharge chambers 14R–14B, across any of the main electrodes 16–16*c* and the common electrode 23, but this auxiliary discharge action causes one of the transistors TR-TB to be driven and, upon application of the source DC1 voltage across one of the main electrodes connected to the thus-driven particular transistor and the common electrode 23, the luminescence quickly takes place in one of the discharge chambers 14R–14B** in which the corresponding main electrode is present.

A further third DC source DC3 is connected to t he common electrode 23 so that this filament type electrodes 23 will be always pre-heated by the source DC3 for promotion of quick luminescence. While in the present lighting circuit the main electrodes **16–16*c* are shown as being the positive electrode and the common electrode 23** as being the negative electrode, they may be of course arranged to be of reverse polarity.

Now, in an event where a red colored light is required, the transistor TR is to be biased to be conducted, so as to apply the first source DC1 voltage across the main electrode 16 and the common electrode 23. The discharge gas sealed in the isolated space of the lamp assembly 10 is excited to irradiate ultraviolet rays, the fluorescent substance 18R in the chamber 14R thus irradiated by the ultraviolet rays transmits the red colored visible light through the permeable plate 25 to the exterior. When the first source DC1 voltage is applied across another main electrode **16*a*, 16*b* or 16*c* and the common electrode 23, the fluorescent substance 18G1, 18G2 or 18B is subjected to the ultraviolet ray irradiation to transmit green or blue colored light through the permeable plate 25 to the exterior in similar manner. It will be appreciated here that only a partial zone of the permeable plate 25 corresponding to the particular chamber thus transmitting the colored light is acting as a light transmitting window. The lamp assembly 10** here forms a picture or image element of the particular colored light and, accordingly, a plurality of the lamp assemblies forming the image elements arranged and actuated properly in a predetermined manner are effective to perform a large size image display or illumination.

According to the colored fluorescent display lamp assembly 10 as has been referred to, the lamp base 19 is formed to be thin to reduce the weight to a large extent. The stem 20 integrally provided to the lamp base 19 makes it possible to omit a conventional working step for sealingly joining a separately prepared part as used with a glass frit or the like sealing means. The lamp base 19 made of transparent glass allows the sealing joint of the base itself to the lamp housing 11 to be easily visually confirmed.

Figure 4:
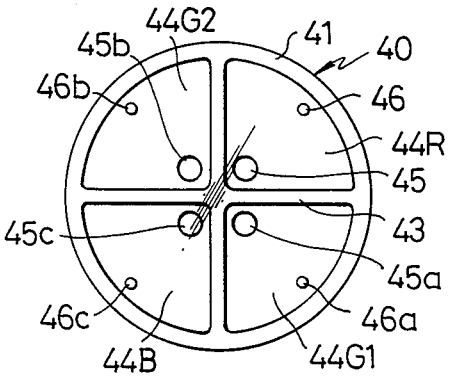
FIGS. 4 and 5 show in plan view other embodiments of the lamp assembly according to the present invention.

In FIG. 4, there is shown another embodiment of the colored fluorescent display lamp assembly according to the present invention, in which the same constituents as in the embodiment of FIGS. 1 and 2 are shown by the same reference numerals but added by 30. In the present instance, a lamp housing 41 is provided in a circular shape in section, and respective discharge chambers 44R–44B will have a quadrant shape in section or plan view. Other arrangements and operation are substantially the same as in the embodiment of FIGS. 1 and 2.

Figure 5:
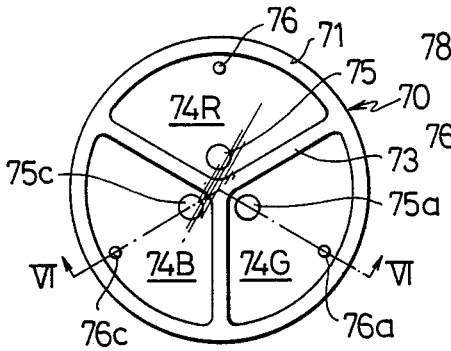
Figure 6:
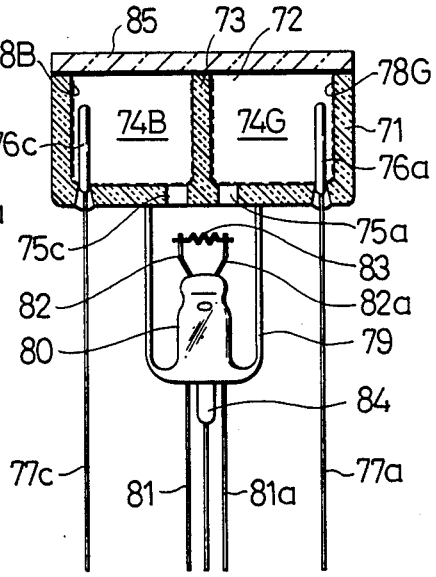
FIG. 6 is a sectioned view of the lamp assembly shown in FIG. 5 taken along line VI—VI therein.

In still another embodiment according to FIGS. 5 and 6, a lamp housing 71 is formed also in circular shape in section, but a separator 73 divides its interior into three discharge chambers 74R, 74G and 74B respectively of a ⅓ sector shape of a circle, and one of the two discharge chambers contributive to the green colored light emission in the foregoing embodiments is omitted here. Other arrangements and operation are substantially the same as in the embodiment of FIGS. 1 and 2, and the same constituents as in that embodiment are denoted by the same reference numerals but added by 60.

Figure 7:
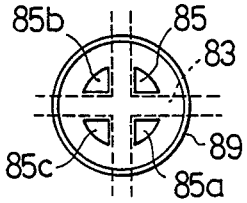
FIGS. 7 and 8 are plan views of other embodiments of the lamp assembly according to the present invention.
Figure 8:
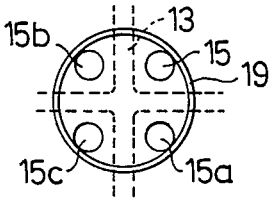
Figure 11:
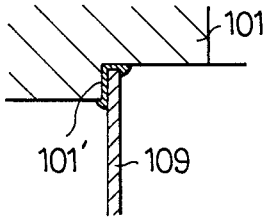
FIG. 11 shows in a fragmentary sectioned view a coupling between a lamp housing and a lamp base in still another embodiment of the present invention.
Figure 9:
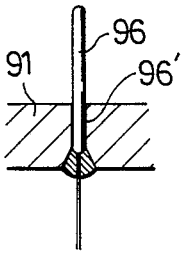
FIGS. 9 and 10 are fragmentary sectioned views showing different mounting techniques for a main electrode
Figure 10:
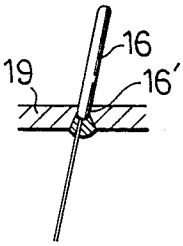

In the foregoing embodiments, by the way, the discharge holes in the discharge chambers have been shown to be provided respectively in a circular shape, and there may arise in this case a risk that the sealing joint at the open end of the lamp base 19 made close to the discharge holes **15–15*c* may happen to become deteriorated due to repeated discharges (see FIG. 8). Such risk can be avoided, however, by employing such sector shaped discharge holes 85–85*c* as shown in FIG. 7, which can be disposed to be spaced from the joint end edge of the lamp base 89. In securing the main electrodes 16–16*c* to the bottom wall of the lamp housing 11 further, a through hole 16' for passing the main electrode is expanded in size toward the exterior bottom surface approach so that sealing is effected by means of the glass frit or the like, and this undesirably enables the main electrode to be easily tilted (see FIG. 10). If the bottom wall provides the through hole 96' with a longer straight portion as in FIG. 9, such tilting of the main electrode 96 can be effectively prevented from occurring. When, for example, the main electrode of a diameter of 1.0 mm is secured in a through hole of a diameter 1.1 mm and a straight portion of a length 3 mm, it has been found that the main electrode tilting can be excellently prevented without the need of any particular jig upon the sealing joint. As shown in FIG. 11, further, a provision of a stepped part 101' to a lamp housing 101 for sealing joint thereto of the lamp base 109 allows the lamp base 109 even of a small thickness to be effectively strongly joined to the housing 101**.

Figure 12:
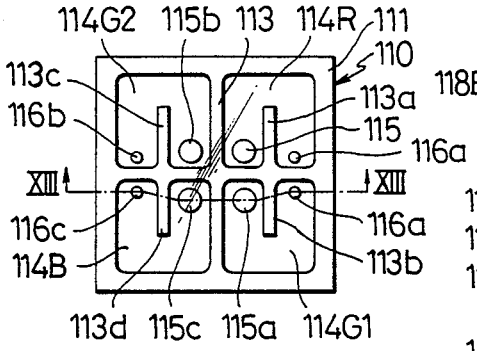
FIG. 12 is a plan view of another embodiment according to the present invention.
Figure 13:
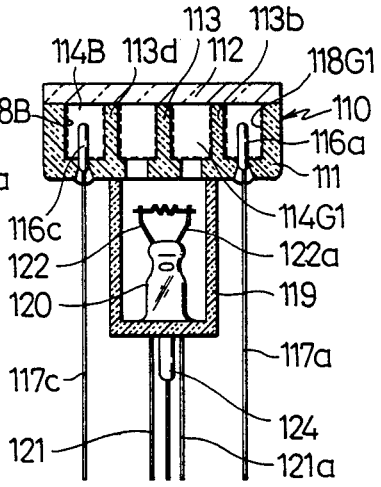
FIG. 13 is a sectioned view taken along line XIII—XIII in FIG. 12.

In another embodiment as shown in FIGS. 12 and 13 of the present invention, a colored fluorescent display lamp assembly 110 is formed to render thermal distribution in the discharge path to be uniform, in discharge chambers 114R, 114G1, 114G2 and 114B defined in lamp housing 111. Referring to the thermal distribution in the discharge path, a main discharge track in the case of the lamp assembly 10 of FIGS. 1 and 2 (where the discharge holes **15–15*c* are disposed close to the intersection of the separator 13 and the main electrodes 16–16*c* are at the diagonally opposing corners) is to be formed on the diagonal line between the hole and the electrode in each of the discharge chambers. It is likely that a temperature lowering takes place substantially at other corners on the other diagonal line intersecting the foregoing diagonal line. When this lamp assembly 10 is utilized specifically in cold places, therefore, a thermal unevenness becomes remarkable so as to cause mercury vapor to condense and deposit on inner surface of the light permeable plate 25 at zones of the lowered temperature to become mirrorlike, whereby the opening rate of the light permeable plate 25 acting as the light permeable window for the respective discharge chambers 14R–14B is lowered to cause the luminance to become deteriorated. The mirrorlike deposited mercury causes a mirror reflection to occur so as to raise so-called black level luminance and thus to deteriorate the contrast. According to the present embodiment of FIGS. 12 and 13, there is taken a measure for allowing the lamp assembly to be satisfactorily durable even in the cold places, by means of (i) main electrodes 116–116*c* located not at the diagonally opposing corners with respect to the discharge holes 115–115*c* which are close to the intersection of separator 113, but rather at adjacent corners on the side of two aligned portions of the cruciform separator 113, and (ii) roundabout partitions 113*a*–113*d* respectively extended from the two aligned portions of the partition 113 at its positions respectively between the discharge hole and the main electrode in each discharge chamber while leaving a space between the extended end and the opposing inner wall surface of the housing 111**.

With the above arrangement, the discharge track in the respective discharge chambers 114R–114B is elongated to be a roundabout path running along both side surfaces of the respective roundabout partitions **113*a*–113*d*** between the respective discharge holes 115–115c and the respective main electrodes 116–116c in each discharge chamber. The discharge gas can be excited substantially in all space in the respective discharge chambers 114R–114B. Accordingly, no thermal unevenness takes place over the entire discharge chambers 114R–114B so as to avoid the mercury deposition, and any deterioration of luminance or contrast can be well restrained.

Figure 14:
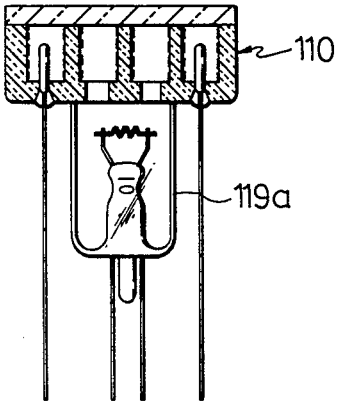
FIG. 14 shows yet another embodiment according to the present invention in a sectioned view taken along substantially the same line as that for FIG. 13.

In the above arrangement the lamp base 119 is shown as in FIG. 13 to be formed by a ceramic or metal and a stem 120 carrying the common electrode is made of a glass, and the lamp base being sealingly bonded to the housing 111 through a glass frit. The lamp base may instead be made of a glass material integrally with the stem, as shown by a numeral 119a in FIG. 14 in the same manner as in FIGS. 1 and 2, so that the assembly can be of a light weight. In the embodiment of FIGS. 12 and 13, further, other arrangements and operations are substantially the same as those in the embodiment of FIGS. 1 and 2, and identical constituents to those in the embodiment of FIGS. 1 and 2 are denoted by the same reference numerals but added by 100.

Figure 15:
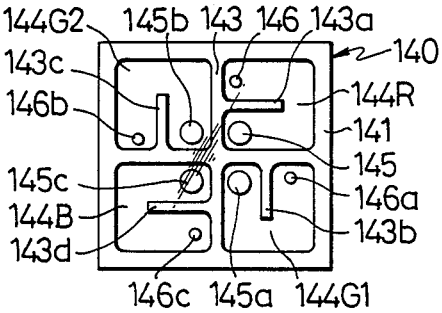
FIGS. 15 and 16 are plan views of still further embodiments according to the present invention.

In a further embodiment shown in FIG. 15, the disposition of main electrodes 146 and 146c in two discharge chambers 144R and 144B is made at corners different than in FIG. 12, but still adjacent the one of the discharge holes 145 and 145c on the side of other two diametrally aligned portions of the cruciform separator 143 than the two on the side of which the remaining main electrodes 146a and 146b are disposed. Likewise, two roundabout partitions 143a and 143d are extended from the other two aligned portions of the separator 143 and between the discharge holes 145 and 145c and the main electrodes 146 and 146c. Other arrangements and operation of this embodiment are substantially the same as those in the embodiment of FIGS. 1 and 2, and identical constituents to those in the FIGS. 1 and 2 embodiment are denoted by the same reference numerals but added by 130.

Figure 16:
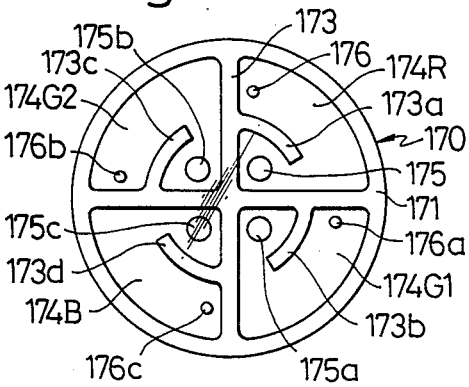
Figure 17:
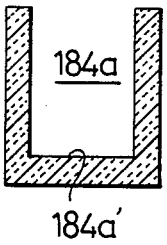
FIGS. 17 to 20 show respectively in a schematic, fragmentary sectioned view a discharge path in further different embodiments according to the present invention.
Figure 18:
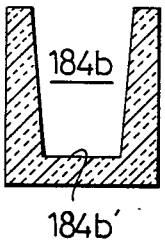
Figure 19:
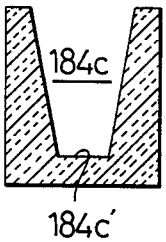
Figure 20:
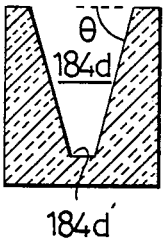

In an embodiment shown in FIG. 16, lamp housing 171 is formed to have a circular section, in contrast to the embodiment of FIG. 15, and respective roundabout partitions 173a–173d are also formed to be arcuate in the same curvature as the outer peripheral wall of the circular section. In the present instance, too, other arrangements and operation are substantially the same as those in the first FIGS. 1 and 2 embodiment and constituents identical to those in the first embodiment are denoted by the same reference numerals but added by 160.

Figure 21:
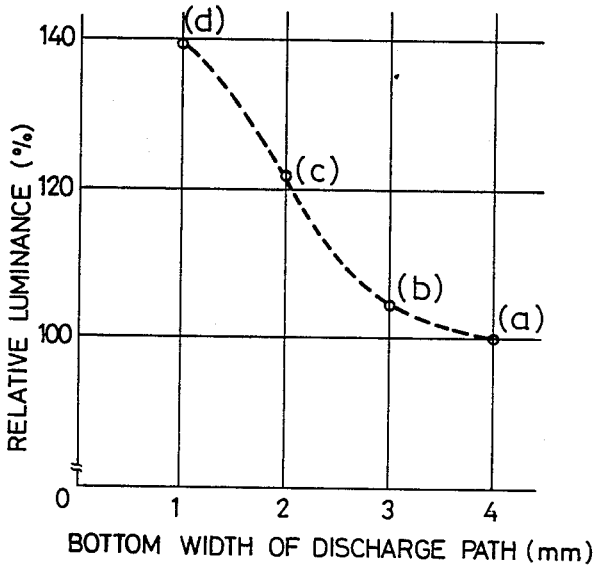
FIG. 21 is a diagram showing the relationship between a bottom width of the discharge path and relative luminance in the lamp assembly of the present invention.

According to another feature of the present invention, attention is directed to the width of bottom wall of the discharge path in the respective discharge chambers, a proper setting of which being capable of improving the luminance efficiency. The cross sectional configuration of the discharge chamber is sequentially varied to decrease the bottom width as shown in FIGS. 17 to 20, so that the respective discharge chambers 184a–184d, all having a top-opening width 4 mm and depth 5 mm will vary in bottom width from 4 mm through 3 mm and 2 mm to 1 mm. Luminance measurements made with respect to these varying discharge chambers, such as shown by dots (a)–(d) in FIG. 21, have shown that the luminance can be elevated by making the bottom width remarkably smaller than the top opening width of the discharge chamber the luminance elevation being remarkable when the bottom width is less than 3 mm. It is considered that this luminance elevation occurs because the varied bottom and side walls of the discharge chamber cause the positive column potential to so vary as to improve the luminance efficiency and emitted light reflection on the side walls can be effectively provided to the lamp surface. In other words, the luminance can be improved by tilting the side walls of the discharge chamber so as to face the top opening. When an angle defined by the place of the top opening and side wall surface is $\theta$, with the depth H and the bottom width W, the cross section of the chamber becomes a triangle when $\tan\theta = 2H/W$ and the depth H has to be varied when $\tan\theta < 2H/W$, and the lower limit of $\tan\theta$ becomes 2H/W. Consequently, it has been found that the angle $\theta$ in a range of $2H/W \leqq \tan\theta < \infty$ improves the luminance.

Figure 22:
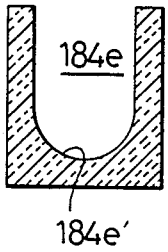
FIG. 22 is a schematic, fragmentary sectioned view of a discharge path in still another embodiment of the present invention.
Figure 23:
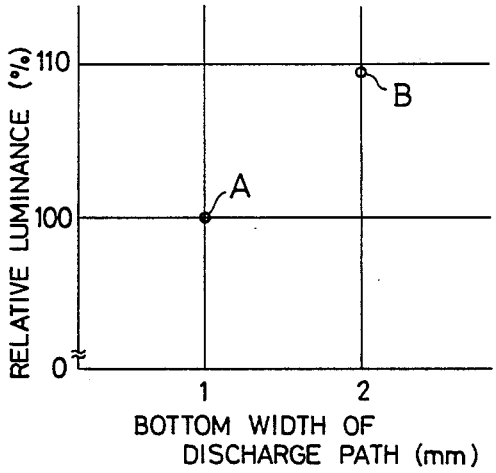
FIG. 23 is a diagram showing the relationship between the discharge path bottom width and the relative luminance in the embodiment of FIG. 22.
Figure 24:
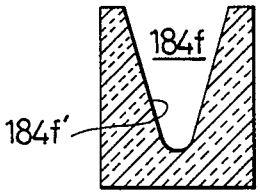
FIGS. 24 and 25 are schematic, fragmentary sectioned views as magnified of the discharge paths in still further embodiments of the present invention.
Figure 25:
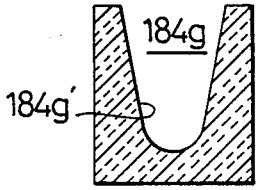

When the discharge chamber is formed as shown in FIG. 22 wherein a discharge chamber 184e is curved in the bottom so as to be substantially semicircular at the bottom 184e' in section, it has been also found that the luminance can be improved as shown by a dot B in FIG. 23, in contrast to a dot A denoting the luminance in the event of the bottom not curved. It appears that this occurs because the discharge chamber bottom curved to be smoothly continuous allows the fluorescent substance to be uniformly applied to the inner wall face of the chamber. When the discharge chamber is tilted at the side walls and curved to be circular at the bottom, as shown in FIG. 24 by a chamber 184f having tilted and curved wall 184f' or in FIG. 25 by a chamber 184g of tilted and curved wall 184g', it should be possible to attain a correlatively increased effect of the foregoing operation of FIGS. 17 to 20 and that of FIG. 22.

Figure 26:
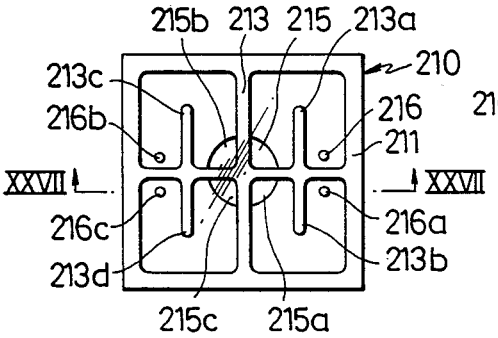
FIG. 26 shows still another embodiment of the present invention in its plan view.
Figure 27:
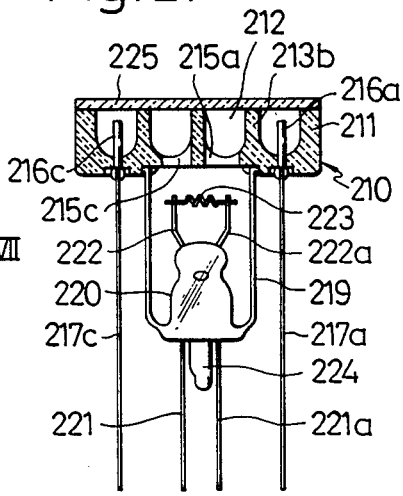
FIG. 27 is a sectioned view taken along line XXVII—XXVII in FIG. 26.

In FIGS. 26 and 27, there is shown still another embodiment, in which a colored fluorescent display lamp assembly 210 attains all advantages obtainable by employing respectively, (i) sector shaped discharge holes 215–215c, (ii) roundabout partitions 213a–213d extending from two aligned portions of cruciform separator 213 as disposed between the discharge holes 215–215c and main electrodes 216–216c at adjacent corners, and (iii) a curved inner wall configuration of the discharge chambers 212. According to this embodiment, a lamp base 219 can be sealingly bonded to the bottom surface of the lamp housing 211 without involving any problem with respect to the sector-shaped discharge holes arranged in a substantially circular pattern in the center of the housing 211. The uniform thermal distribution attained renders the assembly to be durable to be well utilizable even in cold places, and the curved inner wall improves the luminance efficiency to a satisfactory extent. In the present instance, the same constituents as in the first embodiment are denoted by the same reference numerals but added by 200.

According to still another feature of the present invention, a life prolongation and luminance efficiency improvement can be well attained by optimumly setting the discharge chamber width W, the distance L between the main and common electrodes, and discharge gas pressure P. The lamp assemblies of different sizes from 15 mm to 70 mm have been subjected to a continuous lighting under such conditions as in a following Table I, and the average life of use of the respective assemblies has been as also seen in the most right-sided column:

TABLE I

| Lamp Size (mm) | Width W (mm) | Distance L (mm) | Pressure P (Torr) | Avg. Life (h) |
|---|---|---|---|---|
| 15 | 2 | 8 | 4.5 | 2,000 |

TABLE I-continued

| Lamp Size (mm) | Width W (mm) | Distance L (mm) | Pressure P (Torr) | Avg. Life (h) |
|---|---|---|---|---|
| 25 | 4 | 18 | 4.0 | 3,500 |
| 45 | 8 | 34 | 3.5 | 5,000 |
| 70 | 15 | 60 | 2.5 | 5,000 |

The relationship between the filled discharge gas pressure P and the relative luminance efficiency has been investigated with respect to one of the lamp assemblies which has a width W of 4 mm and a distance L of 18 mm, with an application of an identical fluorescent substance to all of the discharge chambers for convenience sake, under a supply of a lamp current made constant to be 10 mA for each of the four discharge chambers, that is, 40 mA for each lamp assembly, and at a normal temperature. Here, the relative luminance efficiency is a quotient of the luminance at the plane of the light permeable plate of the lamp assembly divided by the lamp current.

Figure 28:
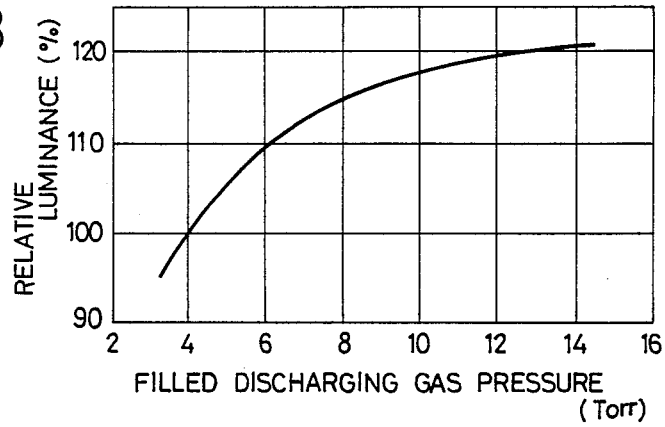
FIGS. 28 to 30 are characteristic diagrams showing the relationship of filled discharge gas pressure to relative luminance efficiency, starting voltage and lighting control voltage, respectively, in the lamp assembly of FIG. 26.

Results of the investigation are as shown in FIG. 28 and, as will be seen in the drawing, the relative luminance increases as the filled discharge gas pressure increases, quite in opposite to the case of well known fluorescent lamps. This appears to occur because the discharge path width is made smaller in the discharge chambers of the lamp assembly according to the present invention, whereby any diffusion loss is decreased to improve the luminance efficiency, while in any known fluorescent lamps the increased gas pressure results in increased collision loss.

Figure 29:
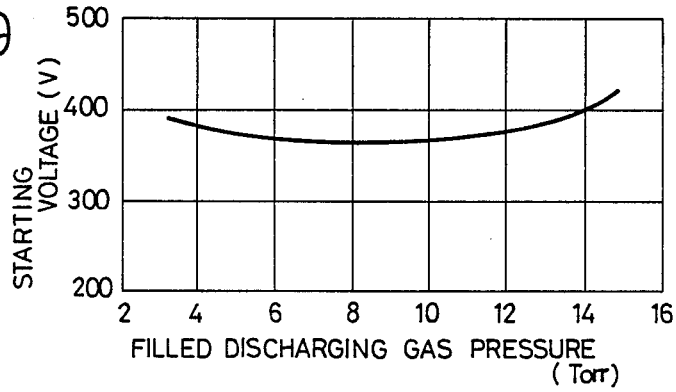
Figure 30:
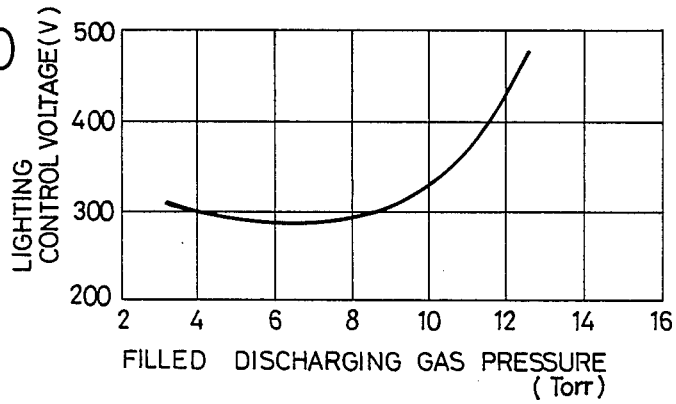

Further, results of measurement at −10° C. of starting voltages for the lamp assembly of the above arrangement are shown in FIG. 29, in which the starting voltage also shows a slightly increasing tendency as the gas pressure P rises, but there is no adverse effect upon the starting. Results of measurement at −10° C. of lighting control voltage also for the lamp assembly of the above arrangement are as in FIG. 30, in which the lamp lighting voltage shows an abrupt rising to result in a false lighting control when the gas pressure P is above 12 Torr.

The relationship of the filled discharge gas pressure P to the average life and to the improvement in the luminance efficiency has been measured and the obtained results were as shown in a following TABLE II:

TABLE II

| Lamp Size (mm) | Filled Gas Pres. (Torr) | Avg. Life (h) | Improvement in Luminance Eff. (%) |
|---|---|---|---|
| 15 | 12 | 6,000 | 25 |
| 25 | 8 | 8,000 | 15 |
| 45 | 6 | 9,000 | 12 |
| 70 | 4 | 9,000 | 8 |

As will be clear in view of the above, a fluorescent lamp assembly excellent in durability and luminance efficiency can be obtained by setting the discharge chamber width W, the distance L between the main and common electrodes and the filled discharge gas pressure P to be 2 mm≦W≦15=mm, 8 mm≦L≦60 mm, and 4 Torr≦P≦12 Torr, respectively.

Figure 31:
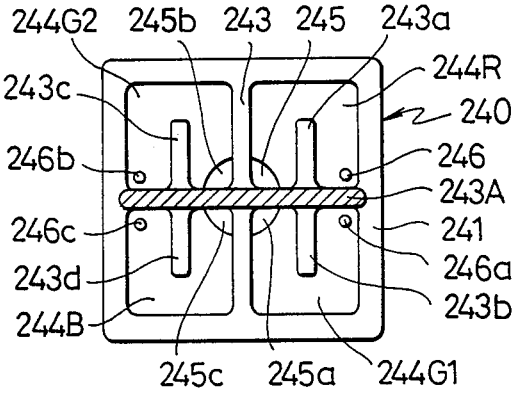
FIG. 31 shows in a plan view a further different embodiment of the lamp device according to the present invention.
Figure 32:
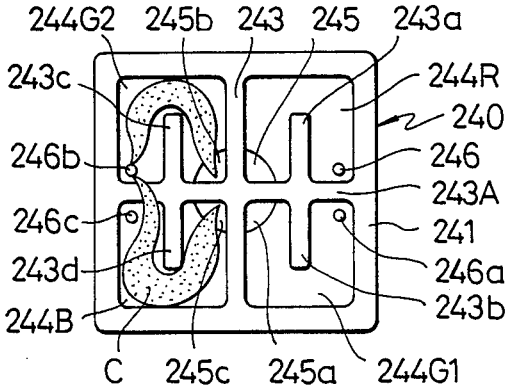
FIGS. 32 to 34 are explanatory views for cross-talk discharge pattern in the lamp assembly of FIG. 31.
Figure 33:
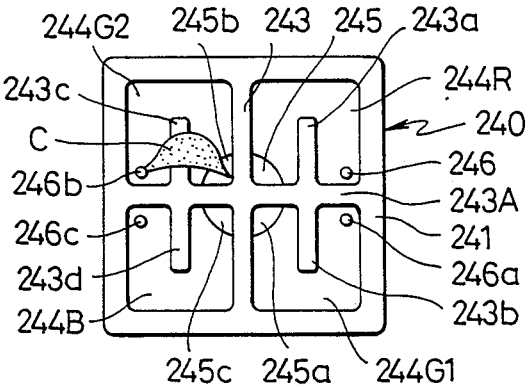
Figure 34:
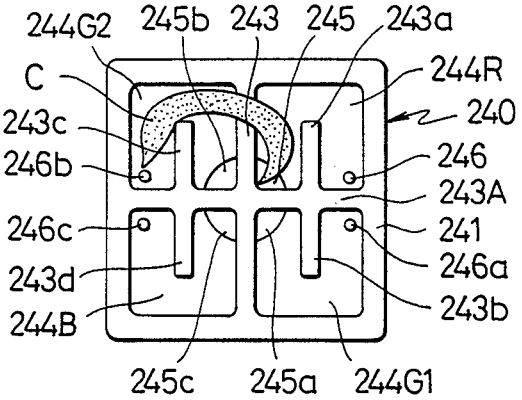

According to yet another, remarkable feature of the present invention, there is provided a measure for restraining any cross-talk discharge not of normal discharge track. Referring to FIG. 31, there is shown a lamp assembly 240 substantially of a similar arrangement to that shown, for example, in FIGS. 26 and 27. In the present instance, a gap reducing member 243A is provided on a separator 243, noticing that the cross-talk discharge can be practically restrained when a gap between the top side edge of the separator 243 and the inner surface of the light permeable plate is less than 0.2 mm. In the case of the assembly of FIGS. 26 and 27, the lamp housing is ceramic and a sufficient flatness cannot be expected at the top open end of the housing as well as the top edge of the separator so that a relatively large gap will be caused to remain after the sealing of the light permeable plate to these edges and the such cross talk discharge C is as shown in various aspects of FIGS. 32–34. In these aspects, the cross-talk discharge C of such aspects as in FIGS. 33 and 34 shifts to a normal discharge track after a certain period elapsed from the starting and they can be ignored, and only such aspect of the cross-talk discharge C as shown in FIG. 32 (which also shows a normal discharge without any symbol C) may be taken into consideration. It should be appreciated here that the gap reducing member 243A renders the gap to be less than 0.2 mm specifically on the top edges of the two aligned portions of the cruciform separator 243, on both sides of which portions the main electrodes 246–246c are closely disposed and from which portions the roundabout partitions 243a–243d extend.

Figure 35:
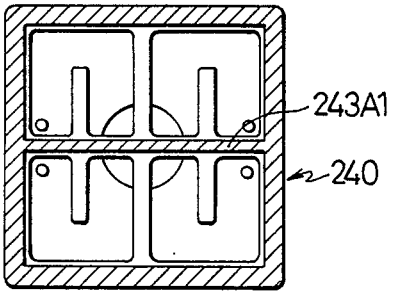
FIGS. 35 to 37 show in plan views still further embodiments of the present invention.
Figure 36:
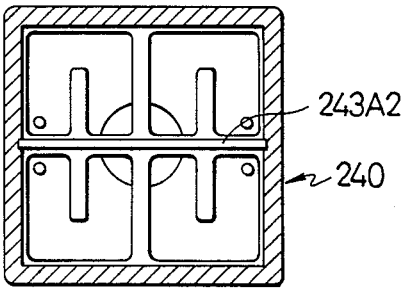
Figure 37:
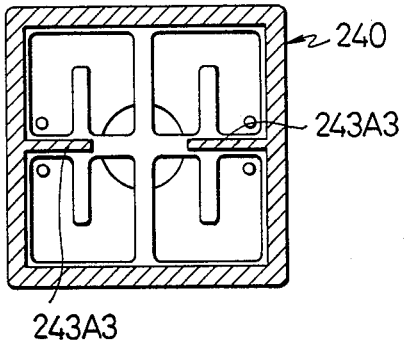

As the gap reducing member 243A, the glass frit employed for sealingly bonding the light permeable plate to the lamp housing may be provided in the form of a screen 243A1 by concurrently printing onto the separator portions with the frit printed on the peripheral wall edge of the lamp housing 240, as shown by shaded part in FIG. 35. It may be also possible to employ a ferrochromium alloy sheet 243A2, as the gap reducing member 243A, in which event the alloy sheet 243A2 also provides an advantage that the sheet functions as a discharge start assisting member (see FIG. 36). In printing the glass frit for the concurrent provision of the gap reducing member, it is possible to omit the printing at a central part of the separator as shown in FIG. 37 so as to provide the reducing member 243A as two opposing parts, with a still obtainable effect equal to that in the case of FIG. 35, while the relatively expensive glass frit can be saved as compared with the case of FIG. 35.

Figure 38:
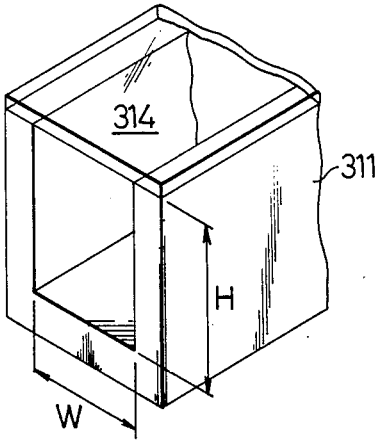
FIG. 38 is a schematic, fragmentary perspective view of the discharge path in a lamp assembly similar to the embodiment of FIG. 12.
Figure 39:
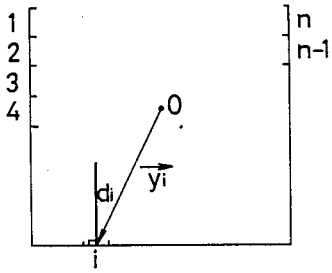
FIG. 39 is a modal expression diagram of the discharge path of FIG. 38.

According to yet another feature of the present invention, the lamp characteristics can be improved by properly setting the relationship between the width W and depth H of the respective discharge chambers in the lamp housing to be in a predetermined range. Referring to FIGS. 38 and 39, it is assumed here that the inner wall surface of a discharge chamber 314 of lamp housing 311 is divided into n elements. The luminescent intensity the i-th element $I_i$ can be obtained on the basis of a distance $\vec{y_i}$ from the center of the positive column to the i-th element and an angle $\alpha_i$ defined by the distance $\vec{y_i}$ and a normal of the i-th element by means of the formula $$I_i = a(k\pi/2y_i)\cos\alpha_i$$

Is that formula a is an efficiency of ultraviolet ray convertion into visible rays, and k is ultraviolet ray output of plasma. At this time, it has been assumed that the positive column output is constant irrespective of the sectional shape of the discharge chamber, and the luminescent intensity of the fluorescent substance is proportional to the intensity of incident ultraviolet rays. Here, the luminance has been obtained by integrating the luminescent amount radiated out of the light permeable plate, with an assumption that, while the light generated by the i-th element is caused to be reflected on the fluorescent substance surface and radiated out of the light permeable plate, 80% of the visible rays will be reflected on the fluorescent substance surface and 100% of the visible rays can pass through the light permeable plate. Results of this operation are shown by a solid line curve in FIG. 40.

Figure 40:
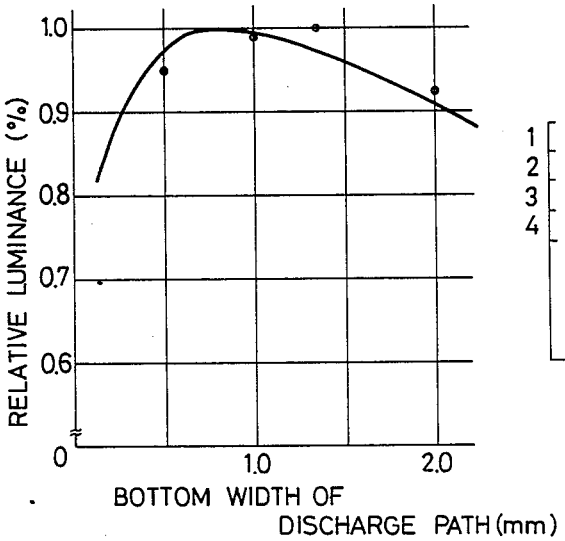
FIG. 40 is a characteristic diagram showing the relationship between the bottom width of the discharge path and the relative luminance in the case of FIG. 38.

Similar measurements have been carried out with the discharge chamber width set to be 2, 4, 8 and 10 mm while varying the depth for every discharge chamber of every width, results of which measurements in the case of a chamber width of 4 mm are given in FIG. 40. For all of these different width discharge chambers, substantially the same results have been obtained. It will be appreciated here that, with a depth/width ratio less than 0.5, the field strength becomes so excessive as to impair the startability, and it has been found that the ratio between the depth H and width W of the discharge chamber at which a luminance of more than 90% of the maximum luminance is obtainable is in a range of 0.5 to 2.0, optimumly, in a range of $W/2 \leqq H \leqq 2W$.

Figure 41:
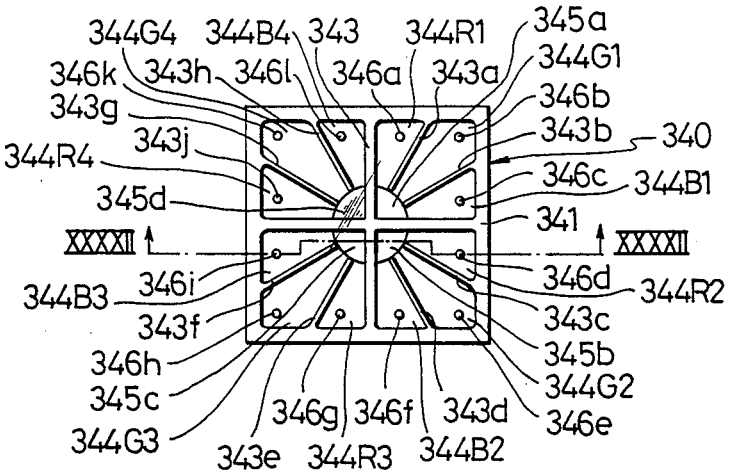
FIG. 41 shows in a plan view still another embodiment of the present invention.
Figure 42:
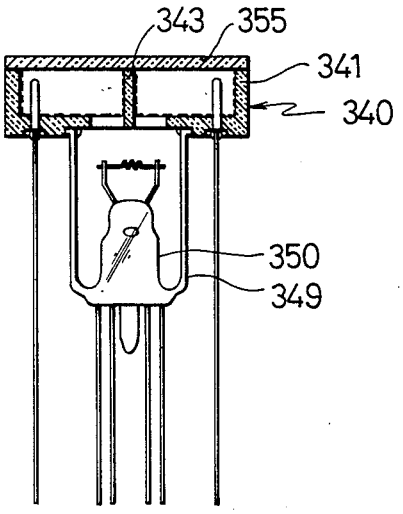
FIG. 42 is a sectioned view of the lamp assembly shown in FIG. 41 taken along line XXXXII—XXXXII therein.

Referring now to FIGS. 41 and 42 showing a further embodiment of the present invention, a colored fluorescent display lamp assembly 340 comprises four sets of picture elements in a lamp housing 341 as defined by a cruciform separator 343. In the respective lamp units, each of sector-shaped discharge holes 345*a*–345*d* is provided adjacent the intersection of four portions of the separator 343. The interior space of the respective units is divided by two partitions 343*a*,343*b*; 343*c*,343*d*; 343*e*,343*f*; or 343*g*,343*h* which are radially extending inward from an outer peripheral wall of the housing 341 to an outer edge of the discharge hole. Each interior space is thus divided into three discharge chambers 344R1, 344G1 and 344B1; 344R2, 344G2 and 344B2; 344R3, 344G3 and 344B3; or 344R4, 344G4 and 344B4, whereby it is made possible to obtain four picture or image elements concurrently with a single lamp assembly 340, rendering the elements of the display device to be highly dense. In the present embodiment, the same arrangements as has been referred to can be employed and equivalent operation and effect can be attained.

Figure 43:
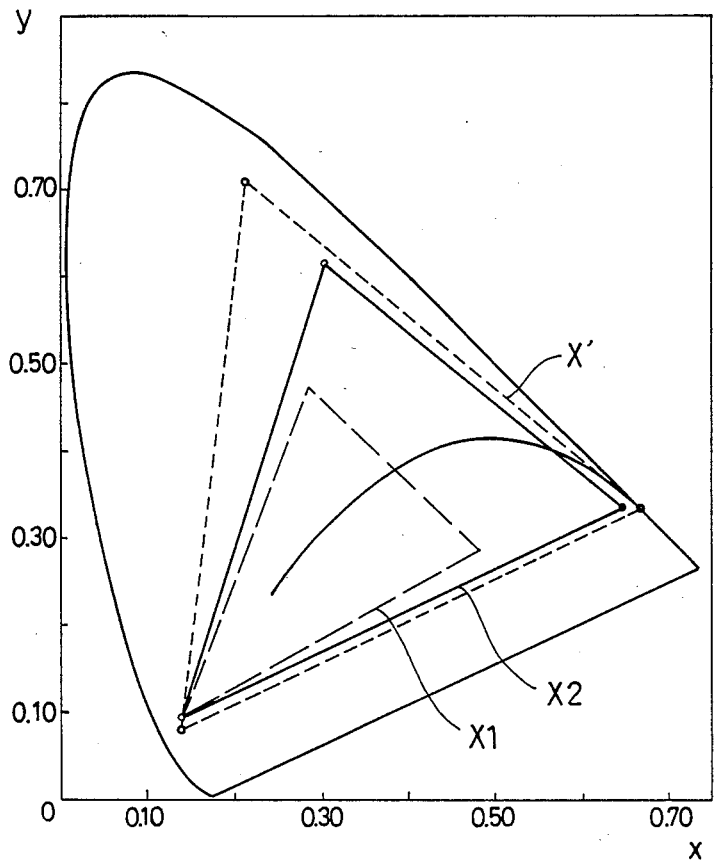
FIG. 43 is a chromaticity diagram relating to different cases of the lamp assembly according to the present invention with a filter employed and not employed for comparison with one another.

In the present invention, further, it is possible to provide the lamp assembly with a color filter member having different color filter sections in the same color arrangement as in the foregoing cases of the fluorescent substances and respectively conforming in size and outline to the discharge chambers. It has been found that, with such color filter member, color reproducibility range of the lamp assembly as well as the display device employing the assemblies can be increased, as represented by a solid line zone X2, in contrast to a dotted line zone X1 for the case not employing the color filter member, in a chromaticity diagram of FIG. 43, in which a further dotted line zone X' denotes NTSC standard chromaticity.

We claim:

1. A colored fluorescent display lamp assembly comprising a lamp housing having a bottom wall, at least one side wall, and an open top side covered by a light permeable plate bonded to said housing, said housing including a separator therein defining a plurality of discharge chambers covered by said plate, a plurality of differently colored fluorescent substances applied to inner surfaces of said chambers, a plurality of main electrodes projecting into respective ones of said chambers whereby said chambers define portions of discharge paths for said main electrodes, a plurality of discharge holes formed in said bottom wall of said housing and arranged generally concentrically in a central region of said bottom wall, said discharge holes forming portions of said discharge paths, an electrode-supporting base open at a top end and sealingly bonded at said top end to an underside of said bottom wall to enclose said discharge holes whereby an inner space formed by said base communicates with said discharge chambers through said discharge holes, a common electrode carried by said base and disposed within said space, said base including a wall formed of a relatively thin, lightweight material whereby said wall of said base is of smaller cross-sectional thickness than said bottom and side wall of said housing.

2. A lamp assembly according to claim 1 wherein said relatively thin, light weight material for said lamp base is a glass.

3. A lamp assembly according to claim 2 wherein said glass is transparent, said lamp base includes a stem, and said common electrode is held by said stem.

4. A lamp assembly according to claim 3 wherein said discharge holes are respectively formed in a sector shape with an angled corner of which being disposed adjacent a center part of said separator, and said lamp base is circular in section.

5. A lamp assembly according to claim 1 wherein said lamp housing is rectangular in outer shape, and said separator is cruciform to define in said housing four of said discharge chambers

6. A lamp assembly according to claim 5 wherein said four discharge chambers are respectively partitioned into three compartments respectively continuous to each of said discharge holes, each of said compartments having one of said main electrodes and each of three of said differently coloring fluorescent substances.

7. A lamp assembly according to claim 1 wherein said lamp housing is circular in outer shape, and said separator is provided in said housing to define at least three said discharge chambers.

8. A lamp assembly according to claim 1 wherein said discharge chambers include respectively a roundabout plate extended from said separator for elongating said discharge path between each of said discharge holes and each of said main electrodes.

9. A lamp assembly according to claim 1 wherein said discharge chambers are respectively formed to satisfy $2H/W \leqq \tan\theta < \infty$ wherein $\theta$ is an angle defined by open side plane and each side wall face, W is an open side width of the chamber and H is depth of the chamber.

10. A lamp assembly according to claim 1 which is formed to satisfy 2 mm$\leqq$W$\leqq$15 mm, 8 mm$\leqq$L$\leqq$60 mm and 4 Torr $\leqq$P$\leqq$12 Torr, wherein W is a width of each of said discharge chambers, L is a distance between the main and common electrodes, and P is a pressure of said discharge gas.

11. A lamp assembly according to claim 1 wherein said light permeable plate is bonded to form a gap between the plate and a top edge of said separator of said discharge chambers to be less than 0.2 mm.

12. A lamp assembly according to claim 1 wherein said discharge chambers are respectively formed to satisfy $W/2 \leqq H \leqq 2W$, wherein W is width and H is depth of the respective chambers.

* * * * *